US006161708A

United States Patent [19]

Myler

[11] Patent Number: 6,161,708

[45] **Date of Patent: *Dec. 19, 2000**

[54] MERCHANDISING DISPLAY SYSTEM HAVING LATERALLY AND LONGITUDINALLY ADJUSTABLE COMPARTMENTS

[75] Inventor: Jeffry A. Myler, Stow, Ohio

[73] Assignee: Darko Company, Inc., Twinsburg, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/956,965

[22] Filed: Oct. 23, 1997

[51] Int. Cl.[7] ..... A47F 5/13; A47F 5/10

[52] U.S. Cl. ..... 211/90.02; 211/106; 211/41.11; 211/184

[58] Field of Search ..... 211/103, 106, 211/41.11, 49.1, 90.03, 90.02, 181.1, 184

[56] References Cited

U.S. PATENT DOCUMENTS

| | | | |
|---|---|---|---|
| 408,464 | 8/1889 | Cruft | 119/513 |
| 660,264 | 10/1900 | Storm | 211/184 |
| 2,889,054 | 6/1959 | Wheeler | 211/53 |
| 2,933,195 | 4/1960 | Radek | 211/153 |
| 3,225,939 | 12/1965 | Braun | 211/186 |
| 3,698,568 | 10/1972 | Armstrong | 211/184 |
| 3,739,918 | 6/1973 | Kreitzburg | 211/44 |
| 4,025,013 | 5/1977 | Anantharaman | 248/205.1 |
| 4,346,806 | 8/1982 | Bustos | 211/59.4 |
| 4,410,093 | 10/1983 | Chiariello et al. | 211/11 |
| 4,606,466 | 8/1986 | Fredrickson | 211/59.1 |
| 4,634,010 | 1/1987 | Otema | 211/96 |
| 4,720,016 | 1/1988 | Kay | 211/96 |
| 4,762,236 | 8/1988 | Jackle et al. | 211/59.3 |
| 4,813,535 | 3/1989 | Radocha et al. | 206/738 |
| 4,905,847 | 3/1990 | Hanson | 211/184 |
| 4,909,402 | 3/1990 | Highsmith | 211/184 |
| 4,930,642 | 6/1990 | Brooks et al. | 211/85.31 |
| 5,096,074 | 3/1992 | Merl | 211/175 |
| 5,119,945 | 6/1992 | Wiggins | 211/59.2 |
| 5,190,186 | 3/1993 | Yablans et al. | 211/124 |
| 5,269,447 | 12/1993 | Gower et al. | 224/542 |
| 5,293,998 | 3/1994 | George | 206/525 |
| 5,305,898 | 4/1994 | Merl | 211/87.01 |
| 5,390,802 | 2/1995 | Pappagallo et al. | 211/59.3 |
| 5,411,146 | 5/1995 | Jarecki et al. | 211/59.2 |
| 5,464,105 | 11/1995 | Mandeltort | 211/184 |
| 5,472,103 | 12/1995 | Merl | 211/187 |
| 5,664,691 | 9/1997 | Boivin-Paradis | 211/184 |
| 5,673,801 | 10/1997 | Markson | 211/59.3 |

OTHER PUBLICATIONS

Three photographs of a bicycle rack being used by Toys R Us.

*Primary Examiner*—Daniel P. Stodola
*Assistant Examiner*—Gregory J. Strimbu
*Attorney, Agent, or Firm*—Renner, Kenner, Greive, Bobak, Taylor & Weber

[57] ABSTRACT

A system (10) of displaying merchandise (24) adjacent to a wall (12) of a retail fixture (11) includes support arms (16) carried by the wall (12). Tubes (19, 20) are carried by the arms (16) and have a plurality of regularly spaced apertures (21) therein. Hoops (22) are positioned through selected of the apertures (21) to define areas that divide items of merchandise (24) from other items of merchandise (24). Frames (25) have legs (28) received through selected of the apertures (21) and also have adjusting wires (29, 30, 31). Support brackets (26) include hoops (32) to maintain the merchandise (24) in the area defined by the hoops (22). The support brackets (26) each also have hooks (34) which engage selected of the wires (29, 30, 31) so that the size of the area for the merchandise (24) may be adjusted.

23 Claims, 3 Drawing Sheets

MERCHANDISING DISPLAY SYSTEM HAVING LATERALLY AND LONGITUDINALLY ADJUSTABLE COMPARTMENTS

TECHNICAL FIELD

This invention relates to a system for displaying merchandise, for example, at a retail establishment. More particularly, this invention relates to such a system which can be used with conventional retail store fixtures to hold a wide variety of varying-sized merchandise in an organized fashion.

BACKGROUND ART

Most retailers display their wares on shelves carried by fixtures, gondolas, or the like. A problem arises when similar goods of differing sizes, such as containers, articles of clothing or the like are displayed on the same shelf of the unit. Due primarily to handling by the potential consumer, such items can easily become mixed up resulting not only in an undesirable, unsightly display, but also in a potential mispurchase by the consumer. At a minimum, the retailer must spend time daily to reorganize his wares.

Moreover, when goods are displayed on flat shelving, they do not attract the attention of the shopper as well as goods which are hanging or are otherwise more visible. However, some goods are not susceptible to being displayed in a hanging fashion, and if the shelving is other than flat, the organization problem discussed above is compounded.

Placing the different sized items in separate bins is also not a workable solution. Not only do the bins significantly add to the costs of the display feature, but also they tend to hide the goods from the desired visual display for the consumer. In addition, the use of bins adds a required and somewhat tedious frequent cleaning problem for the retailer.

In short, the need exists for a merchandising display system which can economically and efficiently display goods, potentially of differing sizes, in an organized fashion, and present those goods to the consumer in an appealing fashion.

DISCLOSURE OF THE INVENTION

It is therefore an object of the present invention to provide a merchandising display system which will present the goods of a retailer, or the like, in an organized fashion.

It is another object of the present invention to provide a merchandising display system, as above, in which goods of differing sizes can be maintained separately by the system.

It is a further object of the present invention to provide a merchandising display system, as above, in which goods of varying physical sizes can be accommodated within a single system.

It is yet another object of the present invention to provide a merchandising display system, as above, which displays the goods in a manner which attracts the attention of the consumer.

It is an additional object of the present invention to provide a merchandising display system, as above, which is inexpensive to manufacture, easy to install on existing retail fixtures, and easily adjusted to accommodate goods of varying physical size.

These and other objects of the present invention, as well as the advantages thereof over existing prior art forms, which will become apparent from the description to follow, are accomplished by the improvements hereinafter described and claimed.

In general, a system for displaying merchandise adjacent to a longitudinally extending wall includes a plurality of support arms carried by the wall. Longitudinally extending tube members are carried by the support arms and, in turn, carry divider members at longitudinally spaced positions therealong. Support members are also carried by the tube members at longitudinally spaced positions. The divider members and the support members thereby define compartments to receive the merchandise.

A preferred exemplary merchandising display system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
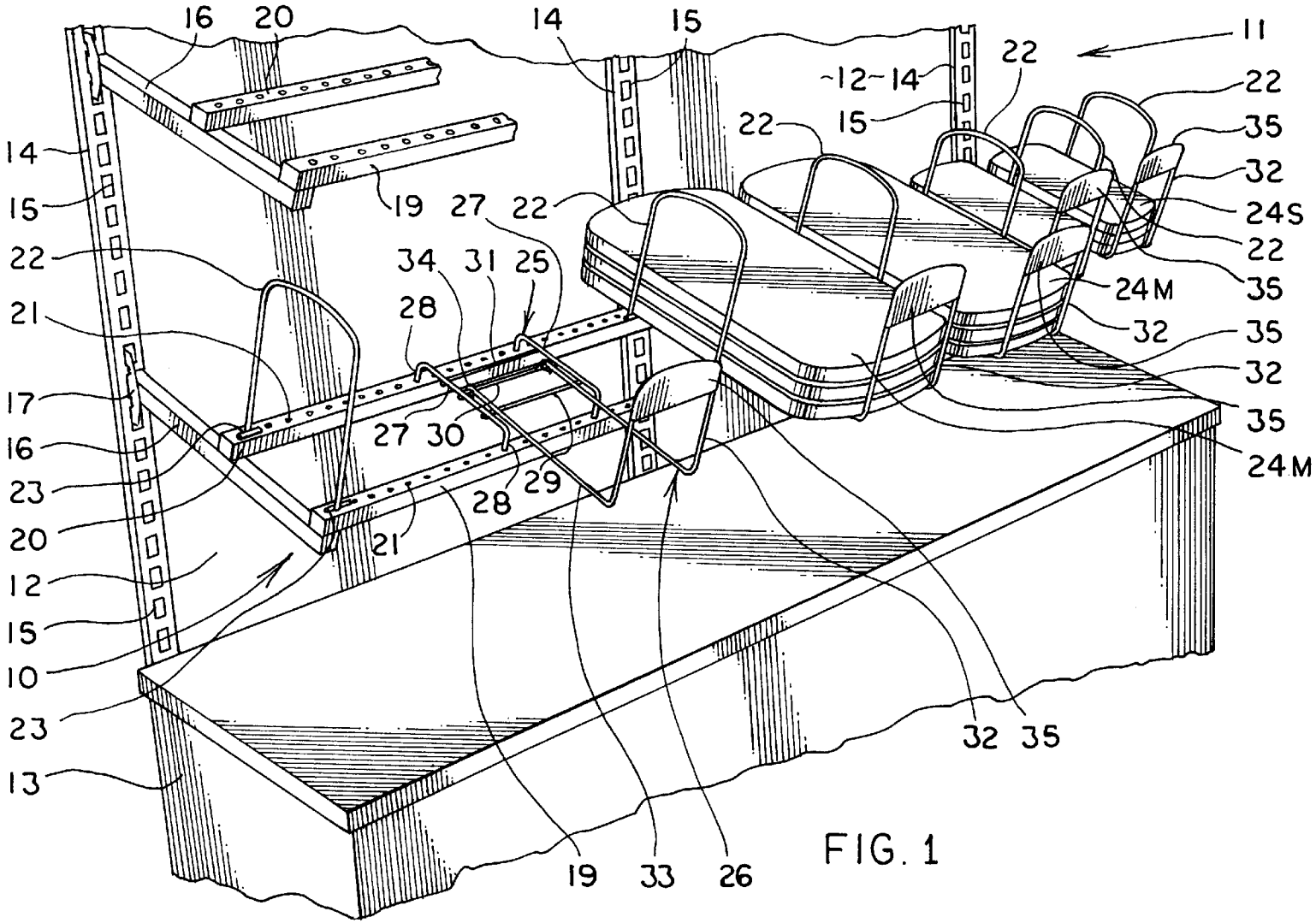
FIG. 1 is somewhat schematic, fragmented perspective view of a retail fixture having a merchandising display system made in accordance with the concepts of the present invention, and showing it as displaying storage container lids of varying sizes.

A merchandising display system made in accordance with the present invention is indicated generally by the numeral 10 in the accompanying drawings and is adapted to be used with a retail display fixture generally indicated by the numeral 11. Fixture 11 can be of any type, such as commonly found against the wall of, or dividing the aisles of, a retail establishment, and includes an upstanding, longitudinally extending wall 12 supported by a base 13. Wall 12 may be provided with conventional longitudinally spaced vertical connector strips 14 having apertures 15 therein which, as is known in the art, are adapted to carry shelves or the like in a vertically spaced manner.

System 10 includes a plurality of support arms 16 having a bracket 17 at one end thereof with hooks 18 (FIG. 2) adapted to be received in selected apertures 15 of strips 14 of fixture wall 12. When mounted on wall 12, arms 16 slope downwardly, preferably at an angle of about fifteen degrees from horizontal, so that system 10 is tilted slightly downward. As such, the goods displayed in system 10 are more visible to the consumer than if system 10 were horizontal.

A pair of hollow tubes 19, 20 are carried by arms 16 and extend longitudinally adjacent to wall 12. Tube 19 may be positioned near or at the laterally outer ends of arms 16, and tube 20 may be positioned generally centrally of arms 16 thereby being laterally spaced from wall 12. Tubes 19 and 20 may be welded to arms 16 if a system 10 is desired to be permanently assembled, or they may be attached in such a away that system 10 can be disassembled. For example, a bolt could extend through each tube 19, 20 and each arm 16 and a wing nut, or the like, used to attach these members together.

Each tube 19 and 20 is provided with a plurality of apertures 21 therethrough which are evenly spaced, preferably at about one inch intervals. Apertures 21 could extend only through the top surface of each tube 19, 20, but preferably the top and bottom surfaces of tubes 19 and 20 are each provided with aligned, spaced apertures.

A plurality of divider members 22, preferably in the form of an arch and made of an inverted U-shaped wire material, can be selectively positioned along tubes 19 and 20. Such is accomplished merely be inserting the ends of the wires at the bottom of arches 22 through selected opposed and aligned apertures 21 in tubes 19 and 20. A cap or clip (not shown) may be provided on the bottom of the ends of arches 22 below tubes 19 and 20 to maintain arches 22 vertically positioned. In addition, small laterally extending pins 23 may be welded to arches 22 near the bottom of the ends thereof to provide lateral stability to arches 22. Moreover, because these pins 23 will rest on the top surface of tubes 19 and 20, the retaining caps or clips would not necessarily be needed as pins 23 themselves would define the vertical position of arches 22.

Figure 2:
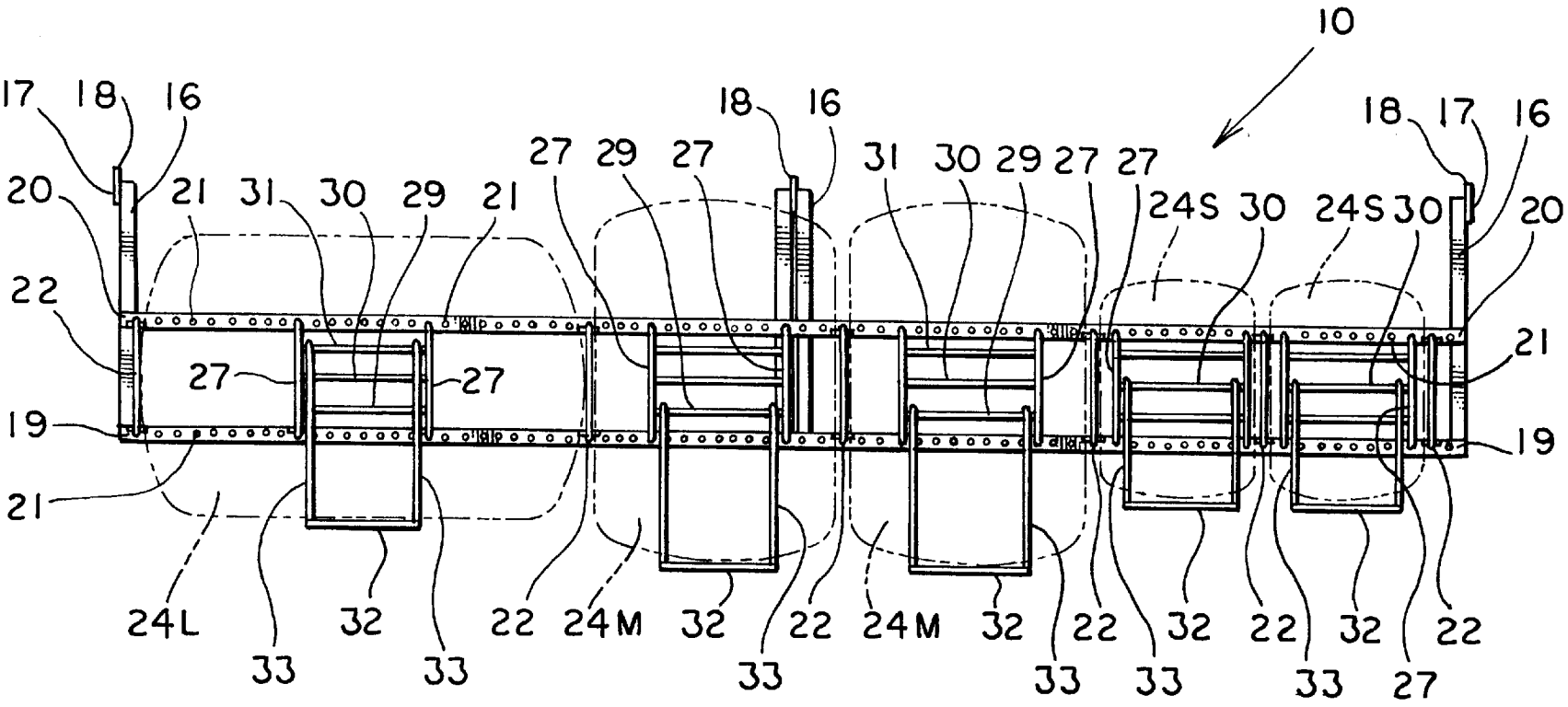
FIG. 2 is a top plan view of the merchandising display system of FIG. 1 with the container lids being shown in phantom.

The selected positioning of arches 22 longitudinally along tubes 19 and 20 is primarily dependent on the size of the products to be displayed. System 10 is shown in FIGS. 1 and 2 as displaying a plurality of stacked container lids 24S, 24M, 24L, collectively referred to as lids 24. As shown, system 10 can accommodate lids 24 of varying sizes. For example, longitudinally from left to right in FIGS. 1 and 2, system 10 is shown as displaying a stack of large lids 24L (not shown in FIG. 1 for clarity), two stacks of medium-sized lids 24M, and two stacks of small lids 24S. As also shown, lids 24 can be oriented differently in system 10; that is, lids 24L, because of their size, have their long dimension aligned with the longitudinal direction of system 10 whereas lids 24M and 24S have their long dimension extending laterally of system 10. arches 22 are positioned along tubes 19 and 20 so as to act as dividers between lids 24L, 24M, and 24S. As such, the lids are longitudinally confined and cannot become unorganized as could happen if the lids were merely placed on a shelf.

System 10 includes two components which cooperate to laterally confine each stack of lids 24L, 24M, and 24S, an adjuster frame generally indicated by the numeral 25, and a support bracket generally indicated by the numeral 26, both of which may be formed of any suitable wire material. As most clearly shown in FIG. 3, each adjuster frame 25 includes opposed support members 27 having legs 28 extending downwardly from the ends thereof. Legs 28 are adapted to be received in selected apertures 21 of tubes 19 and 20 such that support members 27 will generally rest on tubes 19 and 20. The position of each frame 25 in system 10 is again dictated by the size of the goods being displayed. That is, each frame 25 is positioned so that it is generally longitudinally centrally of the product being displayed. A plurality of adjusting positioning wires 29, 30 and 31 extend between support members 27. While three such wires are shown, as will hereinafter become more evident, any number of wires 29 could be provided dependent on the adjustment necessities based on the size of the goods being displayed in a particular system 10.

Figures 3, 4:
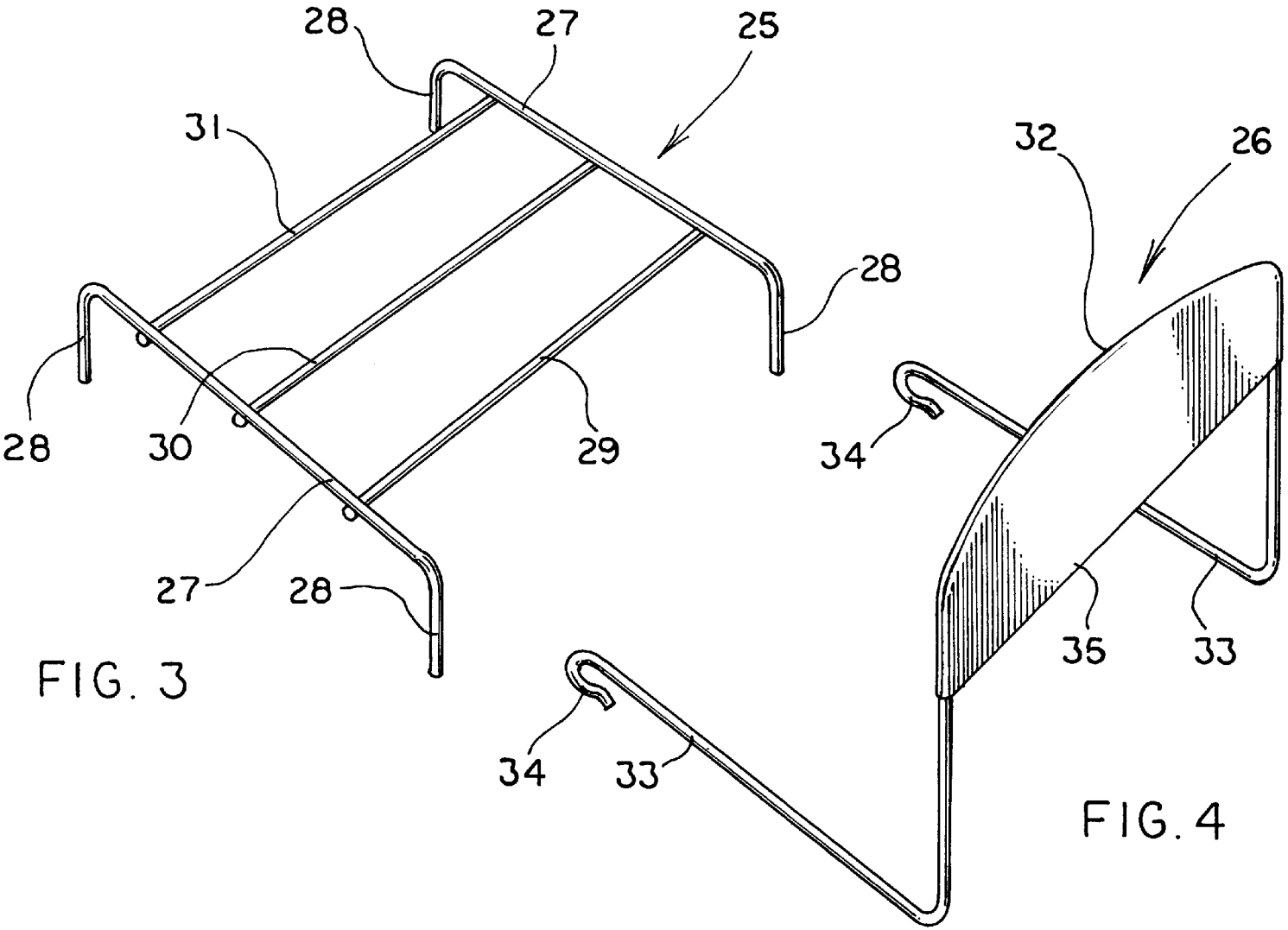
FIG. 3 is a perspective view of an adjuster frame component of the merchandising display system as shown in FIG. 1.
FIG. 4 is a perspective view of a lateral product support bracket of the merchandising display system shown in FIG. 1.

As shown in FIG. 4, each support bracket 26 includes an upstanding support arch portion 32, of a configuration much like arches 22. Arms 33 extend from the bottom of the legs of arch portion 32 and terminate at their other end as hooks 34. Dependent on the size of the product to be displayed, hooks 34 are selectively positioned to engage one of the wires 29, 30, 31 of frame 25. As such, arch portion 32 can be located at different lateral positions relative to wall 12 of fixture 11, and arch portion 32 serves to hold the products in their lateral position. Thus, as shown in FIG. 2, lids 24M extend furthermost away from wall 12 and thus hooks 34 are engaging wire 29. Lids 24S are of the shortest lateral extent and thus, to laterally confine lids 24S, hooks 34 are shown as engaging wire 31. The lateral extent of lids 24L from wall 12 is shown as being between that of lids 24M and 24S and thus hooks 34 are shown as engaging the middle wire 30.

It should thus be evident that support bracket 26 can thus be located at multiple positions (as many positions as there are wires 29), with support arches 32 maintaining lids 24 laterally within system 10. As discussed above, if a finer adjustability is desired, more wires 29 can be provided. Also, as shown, the top of each arch portion 32 can be provided with a plate 35 on which any information, such as product identification, pricing, UPC codes, and the like, may be displayed for the product confined in the compartment defined by arch portion 32 at one end and divider archs 22 on the sides.

Moreover, as somewhat schematically shown in FIG. 1, it is intended that a single wall 12 of a fixture 11 may be provided with more than one vertically spaced system 10. As such, it is only necessary to mount the additional systems on wall 12 in the same fashion as described herein, merely leaving sufficient vertical space between the systems so that the consumer may readily gain access to the goods being displayed.

In view of the foregoing, it should be apparent that a merchandising display system constructed as described herein can hold a wide variety of varying sized articles in an organized fashion and thus accomplishes the objects of the present invention and otherwise substantially improves the art.

What is claimed is:

1. A system for displaying merchandise adjacent to a longitudinally extending wall comprising a plurality of elongate support arms adapted to be carried by and extend laterally outward from the wall, longitudinally extending and laterally spaced tube members attached to said support arms, divider members each having a lower end and an upper end, said lower end of each said divider member including spaced wires interconnected at said upper end so that said divider members are substantially arch-shaped, said lower end of said divider members being connected to said tube members at selected, spaced longitudinal positions along said tube members, support members carried by said tube members at selected, spaced longitudinal positions along said tube members, said divider members and said support members defining adjustable sized compartments adapted to receive the merchandise, and a plurality of frames adapted to be attached to said tube members at selected, spaced longitudinal positions along said tube members, said support members being attached to said frames at selected, discrete lateral positions relative to the wall.

2. A system according to claim 1 wherein each said frame includes a plurality of position adjusting wires, each said support member being connected to a preselected one of said wires of a selected one of said frames thereby positioning each said support member at a preselected lateral position relative to the wall.

3. A system according to claim 2 wherein each said support member includes hooks to engage said preselected one of said wires.

4. A system according to claim 3 wherein each said support member includes arms carrying said hooks and an arch extending upwardly from said arms.

5. A system according to claim 1 further comprising pin members attached to said divider members to provide lateral stability to said divider members.

6. A system according to claim 1 wherein said support arms are adapted to extend downwardly from the wall such that an angle formed between the wall and said support arms is other than ninety degrees.

7. A system according to claim 1 further comprising generally vertical connector strips adapted to be on positioned the wall, said support arms being attached to said connector strips.

8. A system according to claim 1 wherein each of said support members is substantially arch-shaped.

9. A system according to claim 8 further comprising a plurality of plates each carried by a respective one of said support members and adapted to receive information regarding the merchandise.

10. A system according to claim 1 wherein said tube members are provided with longitudinally spaced apertures therein.

11. A system according to claim 10 wherein said lower end of each of said divider members is received by selected of said apertures.

12. A system according to claim 10 wherein said plurality of frames each have a portion thereof received by selected of said apertures.

13. A system for displaying merchandise adjacent to a longitudinally extending wall comprising a plurality of support arms adapted to be carried by the wall, longitudinally extending tube members carried by said support arms, said tube members having longitudinally spaced apertures therein, divider members carried by said tube members at selected, spaced longitudinal positions along said tube members, support members carried by said tube members at selected, spaced longitudinal positions along said tube members, said divider members and said support members defining compartments adapted to receive the merchandise, and a plurality of frames each having a portion received by selected of said apertures, each said frame including a plurality of position adjusting wires, each said support member being connected to a selected one of said wires to position each said support member at a preselected lateral position relative to the wall.

14. A system according to claim 13 wherein each said support member includes hooks to engage said selected one of said wires.

15. A system according to claim 14 wherein each said support member includes arms carrying said hooks and an arch extending upwardly from said arms.

16. A system for displaying merchandise adjacent to a longitudinally extending wall comprising a plurality of elongate support arms adapted to extend laterally outwardly from the wall, a plurality of longitudinally extending laterally spaced members positioned between said support arms, divider members each having a lower end and an upper end, said lower end of each said divider member including spaced wires interconnected at said upper end, said lower end being connected to said longitudinally extending members at selected, spaced longitudinal positions along said longitudinally extending members, and support members each having spaced wires with a component extending upwardly from said spaced wires, said spaced wires of said support members being engageable with said longitudinally extending members at selected, spaced longitudinal positions along said longitudinally extending members and at selected, discrete lateral positions relative to the wall, said divider members and said components of said support members defining compartments which may be laterally and longitudinally adjusted dependent on the size of the merchandise to be confined between said support members and said divider members.

17. A system according to claim 16 wherein said spaced wires each include a hook to engage selected of said longitudinally extending members.

18. A system according to claim 16 further comprising a plurality of frames carried by selected of said longitudinally extending members, said frames including additional longitudinally extending members.

19. A system according to claim 18 wherein said support members are adapted to be connected to selected of said additional longitudinally extending members so that said support members are positioned at said selected, discrete lateral positions relative to the wall.

20. A system according to claim 18 wherein said selected of said longitudinally extending members are in the form of tubes.

21. A system for displaying merchandise adjacent to a longitudinally extending wall comprising at least two support arms adapted to extend laterally outwardly from the wall, laterally spaced tubes carried by said arms and having longitudinally spaced apertures therein, at least three longitudinally spaced arches each having one end received by selected of said apertures to longitudinally define at least two merchandise receiving areas, at least two frames each having legs received by selected of said apertures, one said frame being positioned longitudinally between an adjacent pair of said arches, each said frame including a plurality of position adjusting wires, and a plurality of support members, each said support member being connected to a selected one of said wires to position each said support member at a preselected lateral position relative to the wall.

22. A system according to claim 21 wherein each said support member includes hooks to engage said selected one of said wires.

23. A system for displaying merchandise adjacent to a longitudinally adapted to extend wall comprising support arms extending generally laterally outwardly from the wall, a plurality of longitudinally extending members positioned between said support arms, longitudinally spaced first members having spaced wires extending upwardly from said longitudinally extending members, upper ends of said wires of each said first member being interconnected so that each said first member is substantially arch-shaped, second members having spaced arms carrying hooks to engage selected of said longitudinally extending members at selected spaced longitudinal positions along said longitudinally extending members, said spaced arms of each said second member extending upwardly and being interconnected to form an arch, said arch of each said second member being thereby positioned at a selected lateral position relative to the wall, at least two of said first members defining a longitudinal extent of a compartment for the merchandise and said arch of one of said second members defining a lateral extent of the compartment for the merchandise, said longitudinal and lateral extents thereby being adjustable to confine varying longitudinal and lateral dimensions of the merchandise.

* * * * *

UNITED STATES PATENT AND TRADEMARK OFFICE

CERTIFICATE OF CORRECTION

PATENT NO. : 6,161,708
DATED : December 19, 2000
INVENTOR(S) : Jeffry A. Myler

It is certified that error appears in the above-identified patent and that said Letters Patent is hereby corrected as shown below:

Column 6,
Line 44, delete the words “adapted to extend”, and insert therefor -- extending --.
Line 45, delete the word “extending”, and insert therefor -- adapted to extend --.

Signed and Sealed this

Twentieth Day of August, 2002

*Attest:*

*Attesting Officer*

JAMES E. ROGAN
*Director of the United States Patent and Trademark Office*